US008830289B2

(12) United States Patent
Iwai

(10) Patent No.: US 8,830,289 B2
(45) Date of Patent: Sep. 9, 2014

(54) OPTICAL SCANNING APPARATUS AND IMAGE FORMING APPARATUS INCLUDING OPTICAL SCANNING APPARATUS

(75) Inventor: Hitoshi Iwai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/437,300

(22) Filed: Apr. 2, 2012

(65) Prior Publication Data

US 2012/0269551 A1 Oct. 25, 2012

(30) Foreign Application Priority Data

Apr. 20, 2011 (JP) ..... 2011-094156
Feb. 14, 2012 (JP) ..... 2012-029865

(51) Int. Cl.
*B41J 27/00* (2006.01)

(52) U.S. Cl.
USPC ..... 347/261

(58) Field of Classification Search
USPC ..... 347/231, 242, 243, 245, 257, 259–261, 347/263
See application file for complete search history.

(56) References Cited

U.S. PATENT DOCUMENTS

| | | | | | |
|---|---|---|---|---|---|
| 5,357,272 | A * | 10/1994 | Watanabe et al. | ..... | 347/257 |
| 7,471,433 | B2 * | 12/2008 | Shima et al. | ..... | 359/200.1 |
| 2002/0051635 | A1 | 5/2002 | Morofuji | | |
| 2004/0056963 | A1 | 3/2004 | Ishikawa | | |

FOREIGN PATENT DOCUMENTS

| | | | | | |
|---|---|---|---|---|---|
| CN | 1142155 | A | | 2/1997 | |
| CN | 1920689 | A | | 2/2007 | |
| CN | 1932586 | A | | 3/2007 | |
| JP | 08278460 | A | * | 10/1996 | ..... B41J 2/44 |
| JP | 2003-307762 | A | | 10/2003 | |
| JP | 2006010814 | A | * | 1/2006 | ..... G02B 26/12 |
| JP | 2008-003327 | A | | 1/2008 | |
| JP | 2009-198890 | A | | 9/2009 | |

* cited by examiner

*Primary Examiner* — Hai C Pham
(74) *Attorney, Agent, or Firm* — Canon USA Inc IP Division

(57) ABSTRACT

At the time of forming an image, a rise in a temperature of a drive motor generates distortion in a bottom of a optical box of an optical scanning apparatus. If an opening is formed on the optical box to release heat, the optical box becomes easily distorted. To solve such a problem, according to the present invention, the optical scanning apparatus includes a rib which crosses over the opening formed at the bottom of the optical box.

17 Claims, 20 Drawing Sheets

OPTICAL SCANNING APPARATUS AND IMAGE FORMING APPARATUS INCLUDING OPTICAL SCANNING APPARATUS

BACKGROUND OF THE INVENTION

1. Field of the Invention

The present disclosure relates to an optical scanning apparatus and an image forming apparatus including the optical scanning apparatus.

2. Description of the Related Art

An image forming apparatus employing an electrophotographic method, such as a laser beam printer or a copying machine, includes an optical scanning apparatus which emits a light beam for exposing a photosensitive member. The image forming apparatus forms an electrostatic latent image on the photosensitive member using the light beam emitted from the optical scanning apparatus. The image forming apparatus then develops the electrostatic latent image using toner and forms an image.

FIG. 13 is a perspective view illustrating the optical scanning apparatus. Referring to FIG. 13, the light beam emitted from a light source 1301 is deflected by a reflection surface of a polygon mirror 1302. The light beam deflected by the polygon mirror 1302 then passes through fθ lenses 1303 and 1304, is reflected by a reflection mirror 1305, and reaches a surface of the photosensitive member. Optical members such as the polygon mirror 1302, the fθ lenses 1303 and 1304, and the reflection mirror 1305 are mounted on a housing 1306 of the optical scanning apparatus.

When the image forming apparatus forms an image, the polygon mirror 1302 is rotationally driven by a drive motor. In general, the drive motor rotates at high speed, i.e., at 20,000 rpm to 40,000 rpm, so that temperature of the drive motor rises by 15° C. or more after a few minutes from starting to be driven. Temperature distribution is thus generated inside the housing 1306 due to heat generated by the drive motor becoming driven. The heat distribution causes uneven deformation of the housing 1306 to generate distortion.

In particular, since an amount of rise in temperature is greater in a portion where the drive motor is disposed as compared to other portions, an amount of deformation of the portion where the drive motor is disposed becomes relatively larger. As a result, the housing 1306 sags at a bottom to be basin-like shape with the drive motor as a center, as illustrated in FIG. 14. Referring to FIG. 14, the amount of distortion is exaggerated as compared to an actual amount of distortion so that deformation is easily recognizable. Since the deformation changes orientation of the optical members mounted on the housing 1306 from the desired orientation, an optical path of the light beam is changed from the desired optical path. Quality of the formed image is thus deteriorated.

In response to the above problem, Japanese Patent Application Laid-Open No. 2009-198890 discusses an optical scanning apparatus in which an opening is formed in the vicinity of the drive motor to allow the housing to be capable of ventilation between inside and outside the housing. By forming an opening, the heat inside the housing is released, so that deformation of the housing can be suppressed.

The optical scanning apparatus discussed in Japanese Patent Application Laid-Open No. 2009-198890 is capable of reducing heat deformation by forming the opening. However, strength (i.e., rigidity) of a peripheral portion of the opening is lowered by forming the opening.

Referring to FIG. 13, ribs (e.g., ribs 1307) which are reinforcement members are disposed in the housing of the optical scanning apparatus to increase the rigidity. Since the ribs are not disposed in a periphery of the opening in the optical scanning apparatus discussed in Japanese Patent Application Laid-Open No. 2009-198890, the rigidity of the periphery of the opening is reduced.

SUMMARY OF THE INVENTION

According to an aspect of the present disclosure, An optical scanning apparatus comprising: a light source to emit a light beam; a rotational polygon mirror configured to deflect the light beam so the deflected light beam scans the a photosensitive member; a motor configured to rotationally drive the rotational polygonal mirror; and an optical box in which the rotational polygon mirror and the drive motor are disposed, wherein the optical box includes an opening and a connecting member configured to cross over the opening.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the disclosure will be described in detail below with reference to the drawings.

Figure 1:
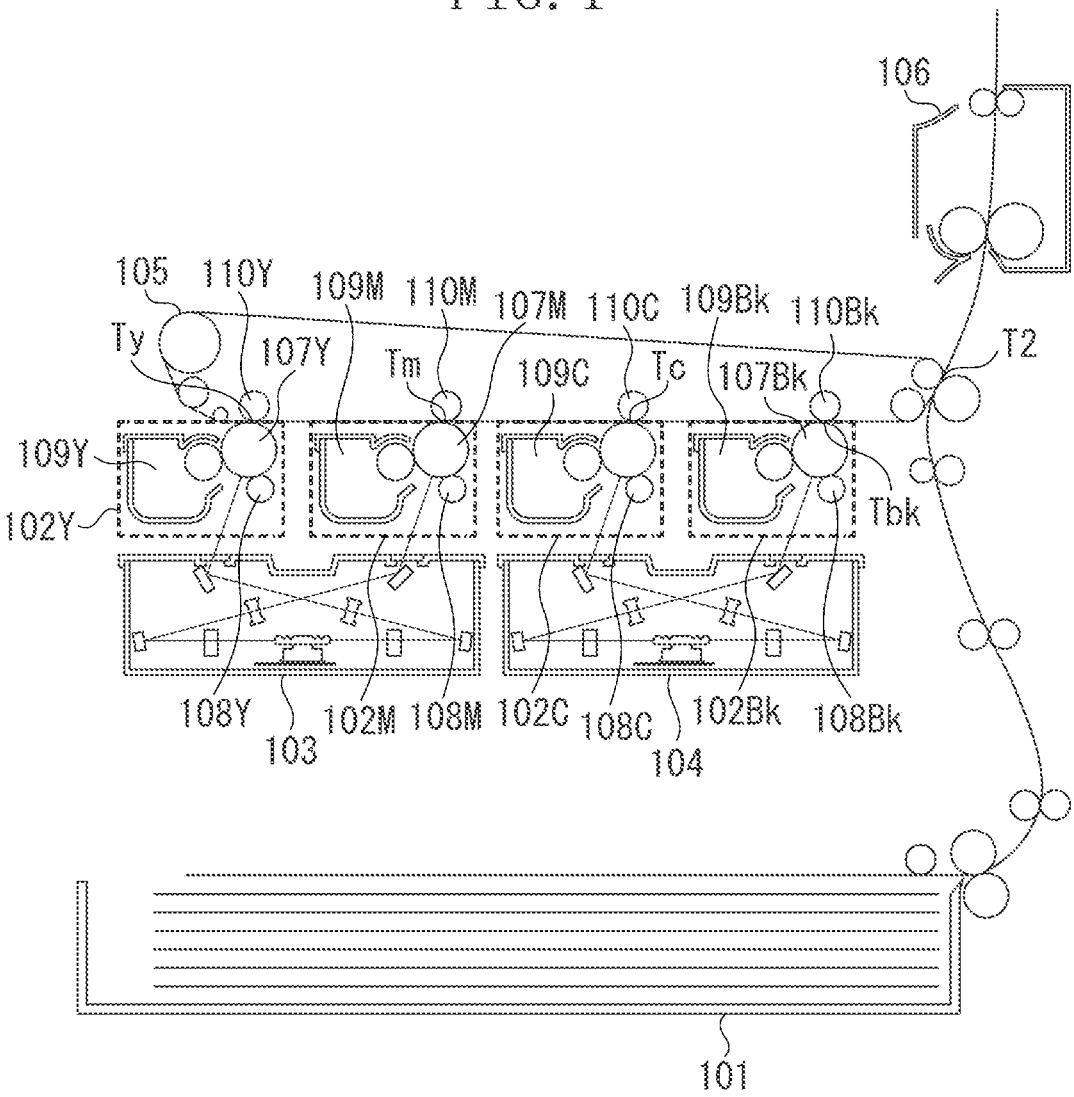
FIG. 1 is a schematic cross-sectional view illustrating a main portion of an image forming apparatus.

The first exemplary embodiment will be described below. FIG. 1 is a schematic cross-sectional view illustrating a main portion of an electrophotographic image forming apparatus according to the present exemplary embodiment. Referring to FIG. 1, the image forming apparatus includes a sheet feed unit 101 which feeds sheets, an image forming unit 102Y which forms a yellow toner image, an image forming unit 102M which forms a magenta toner image, an image forming unit 102C which forms a cyan toner image, and an image forming unit 102Bk which forms a black toner image. Since the component of each image forming unit is the same, the configuration of the image forming unit will be described below using image forming unit 102Y. The image forming unit 102Y includes a photosensitive drum 107Y, i.e., a photosensitive member, a charging apparatus 108Y, and a developing apparatus 109Y.

When the image forming apparatus forms an image, the charging apparatus 108Y charges a surface of the photosensitive drum 107Y. An optical scanning apparatus 103 to be described below then exposes the charged photosensitive drum 107Y, so that the electrostatic latent image is formed on the photosensitive drum 107Y. The electrostatic latent image is made a visible image (developed) by yellow toner supplied from the developing apparatus 109Y.

Each of the image forming units 102M, 102C, and 102Bk similarly includes photosensitive drums 107M, 107C, and 107Bk, charging apparatuses 108M, 108C, and 108Bk, and developing apparatuses 109M, 109C, and 109Bk respectively. Functions of each of the elements are similar to those of the elements included in the image forming unit 102Y.

The toner image formed on the photosensitive drum in each image forming unit is transferred from the photosensitive drum to an intermediate transfer belt 105 at a primary transfer portions (i.e., Ty, Tm, Tc, and Tbk). The toner images transferred to the intermediate transfer belt 105 are then collectively transferred to a recording sheet conveyed from the sheet feed unit 101 to a secondary transfer unit T2. The recording sheet on which the toner images are transferred is conveyed to a fixing apparatus 106 which heat-fixes the toner image on the recording sheet 106. The recording sheet on which the fixing apparatus 106 has performed the fixing process is discharged to outside the image forming apparatus.

Next, the optical scanning apparatus will be described below. The optical scanning apparatus 103 exposes the photosensitive drums 107Y and 107M included in the image forming units 102Y and 102M, and an optical scanning apparatus 104 exposes the photosensitive drums 107C and 107Bk included in the image forming units 102C and 102Bk. Each photosensitive drum is exposed to the light beam, so that the electrostatic latent image is formed on the surface thereof.

Since the optical scanning apparatuses 103 and 104 are similarly configured, the optical scanning apparatus 103 will be described below as an example.

Figure 2A:
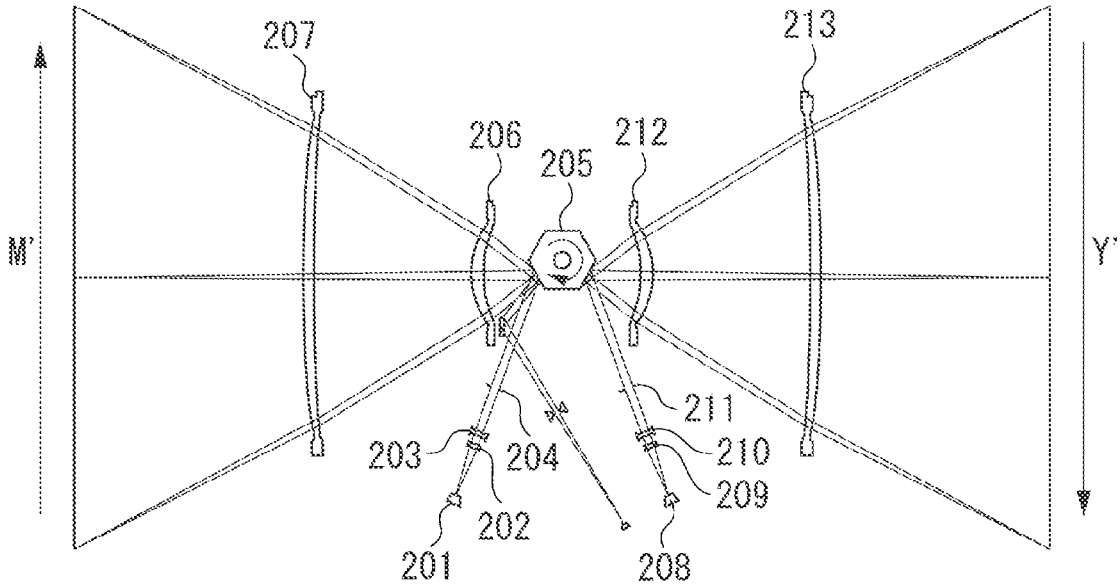
FIGS. 2A and 2B are schematic diagrams illustrating an internal configuration of an optical scanning apparatus.

FIG. 2A is a main scan cross-sectional view illustrating the optical path of the optical scanning apparatus 103 illustrated in FIG. 1, expanded on one plane. The main scan cross-section is a plane to which a rotational shaft of the drive motor that drives a polygon mirror to be described below is a normal.

Referring to FIG. 2A, the optical scanning apparatus 103 includes a light source 201 for emitting the light beam to which the photosensitive drum 107M is exposed. The light beam (i.e., a laser light) emitted from the light source 201 is converted to a parallel light flux by a collimator lens 202 and becomes convergent light by a cylindrical lens 203 disposed immediately after the collimator lens 202. The cylindrical lens 203 has refractive power to converge the light flux in a direction corresponding to a sub-scanning direction of the photosensitive drum 107M (i.e., a rotational direction of the photosensitive drum 107M). The light beam passing through the cylindrical lens 203 is formed into a predetermined shape by a diaphragm 204 and linearly focused on the reflection surface of a polygon mirror 205, i.e., a rotational polygon mirror.

Figure 2B:
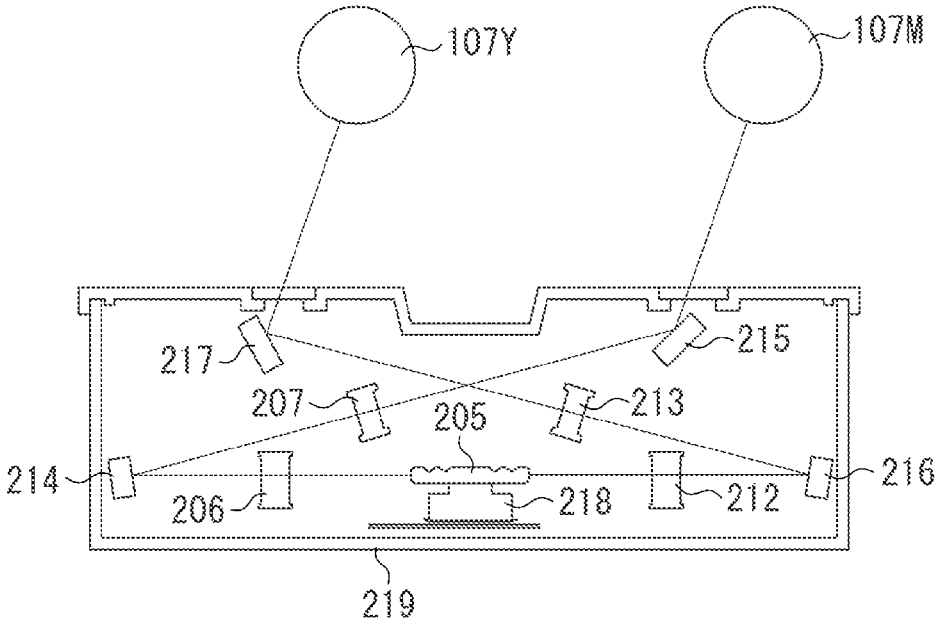

FIG. 2B is a schematic cross-sectional view of the optical scanning apparatus 103. Referring to FIG. 2B, the polygon mirror 205 is rotatably driven by a drive motor 218. The light beam emitted from the light source 201 is deflected by the rotating polygon mirror 205 and is thus converted to a scanning light beam (a deflected light beam) which is caused to scan (i.e., moves on) the photosensitive drum 107M in a predetermined direction (i.e., in a direction of an arrow M'). The scanning light beam passes through an fθ lens 206, i.e., one of optical members, is reflected by a reflection mirror 214, and then passes through an fθ lens 207. A reflection mirror 215 guides the scanning light beam which passed through the fθ lens 207 to the photosensitive drum 107M. The scanning light beam which has passed through the fθ lenses 206 and 207 moves on the photosensitive drum 107M in a predetermined direction at constant speed.

Further, the optical scanning apparatus 103 includes a light source 208 which emits the light beam to which the photosensitive drum 107Y is exposed. The light beam emitted from the light source 208 is converted to a parallel light flux by a collimator lens 209 and becomes convergent light by a cylindrical lens 210 disposed immediately after the collimator lens 209. The cylindrical lens 210 has the refractive power to converge the light flux in the direction corresponding to the sub-scanning direction of the photosensitive drum 107Y (i.e., the rotational direction of the photosensitive drum 107Y). The light beam passing through the cylindrical lens 210 is formed into a predetermined shape by a diaphragm 211 and linearly-focused on the reflection surface of the polygon mirror 205, i.e., the rotational polygon mirror.

Referring to FIG. 2B, the light beam emitted from the light source 208 is deflected by the rotating polygon mirror 205 and is thus converted to the scanning light beam which is caused to scan (i.e., moves on) the photosensitive drum 107Y in a predetermined direction (i.e., in a direction of an arrow Y'). The scanning light beam passes through an fθ lens 212, i.e., an optical member, is reflected by a reflection mirror 216, and then passes through an fθ lens 213. A reflection mirror 217 guides the scanning light beam which passed through the fθ lens 213 to the photosensitive drum 107Y. The scanning light beam which has passed through the fθ lenses 206 and 207 moves on the photosensitive drum 107M in a predetermined direction at constant speed.

The polygon mirror 205, the drive motor 218, the various lenses, and the reflection mirrors are contained inside a housing 219 (an optical box). The housing 219 is formed of a material which has been reinforced by mixing glass fiber in polyphenylene ether (PPE) and polystyrene (PS) resin.

As described above, the temperature in the vicinity of the polygon mirror 205 rises by 15° C. or more after a few minutes from when the drive motor has started rotating. Since the housing 219 is formed of resin, it is easily thermally-deformed. Particularly inside the optical scanning apparatus, the optical members such as the polygon mirror 205, various lenses, and the reflection mirrors are contained, so that the heat generated from the drive motor 218 is not uniformly diffused in the housing 219. As a result, when the image forming apparatus forms an image, heat distribution is generated in the housing 219.

Figure 14:
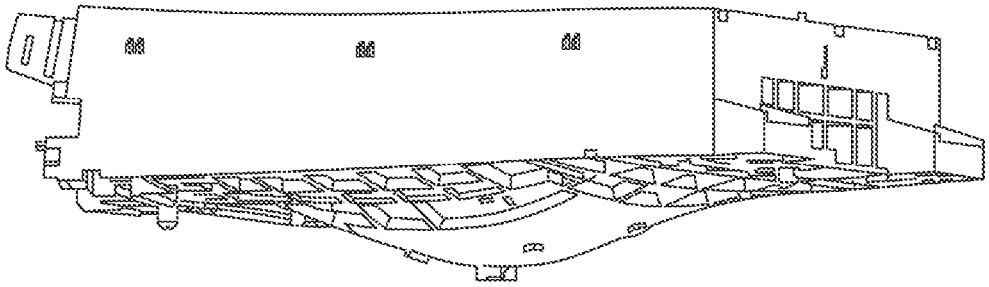
FIG. 14 illustrates deformation of an optical case.

In particular, the amount of a rise in temperature becomes greater in the peripheral portion of the polygon mirror 205 as compared to portions other than the peripheral portion (i.e., outside the peripheral portion). An amount of thermal deformation thus relatively increases in the peripheral portion, and basin-like shape deformation is generated in the bottom of the housing 219 as illustrated in FIG. 14.

If the bottom becomes deformed to be basin-like shape, relative positional relations between the optical members become deformed, so that the optical path of the light beam is changed. As a result, the light beam is not focused on a desired position on the photosensitive drum. For example, the orientations of the reflection mirrors 214 and 216 greatly affect the optical path. If an angle in which each of the reflection mirrors 214 and 216 is positioned is changed by several minutes, an image forming position of the light beam on the photosensitive drum becomes displaced in the sub-scanning direction by 40 to 50 μm.

When the image forming apparatus forms the image by superimposing four color toner images, the above-described displacement of the image forming position of the light beam is visualized as color mis-registration and causes image quality deterioration. In particular, according to the present exemplary embodiment, the image forming apparatus employs the optical scanning apparatus that causes a plurality of light beams to scan in two directions opposing each other across the polygon mirror 205. The deformation of the housing 219 causes an irradiation position to be changed symmetrically. A relative amount of color mis-registration thus doubles to 80 to 100 μm.

According to the present exemplary embodiment, an opening is formed in the housing 219 of the optical scanning apparatus to release the heat inside the housing 219 generated by the temperature rise caused by the polygon mirror 205. Further, according to the present exemplary embodiment, reinforcement unit (reinforcement member, i.e., a connecting unit (member)) is disposed in the optical scanning apparatus for securing rigidity in the peripheral portion of the opening which has been reduced by forming the opening.

Figure 3A:
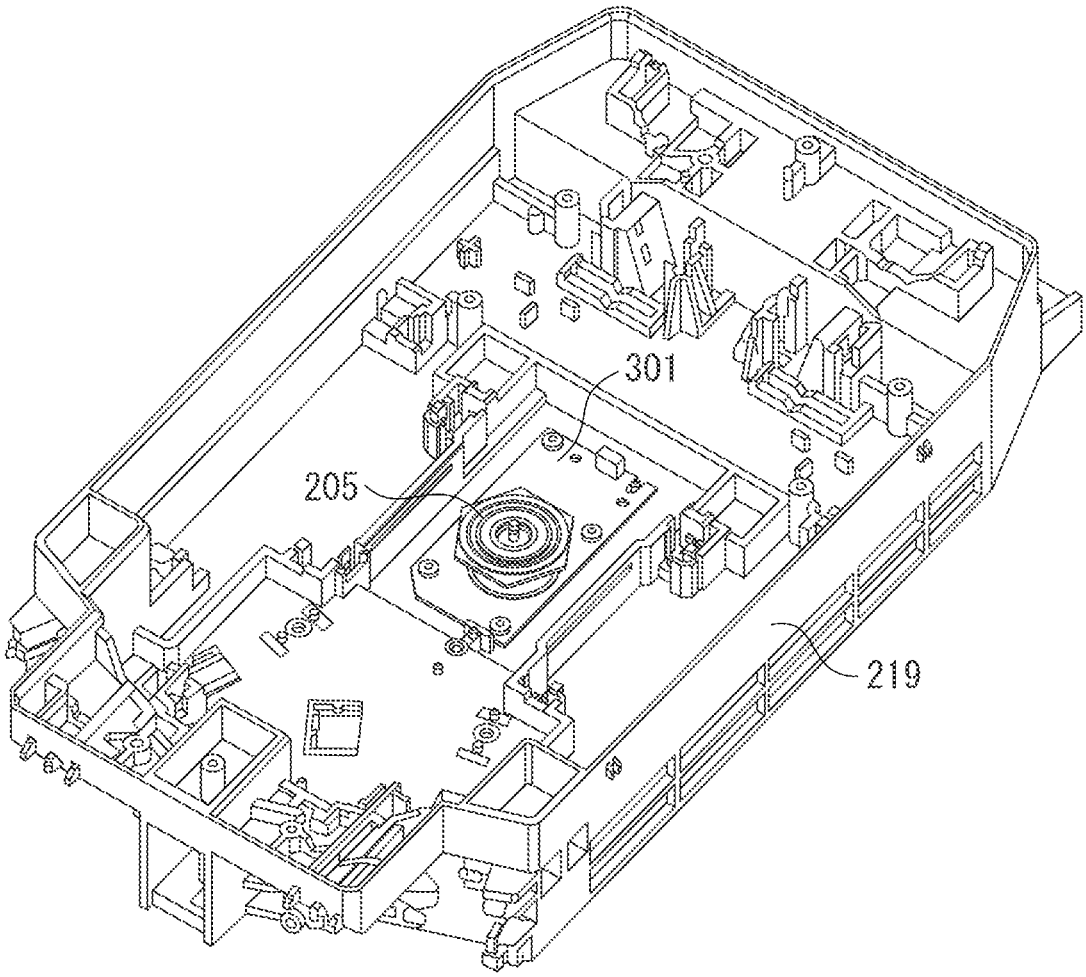
FIGS. 3A, 3B, and 3C are schematic diagram and enlarged views thereof illustrating an internal configuration of the optical scanning apparatus.
Figure 3B:
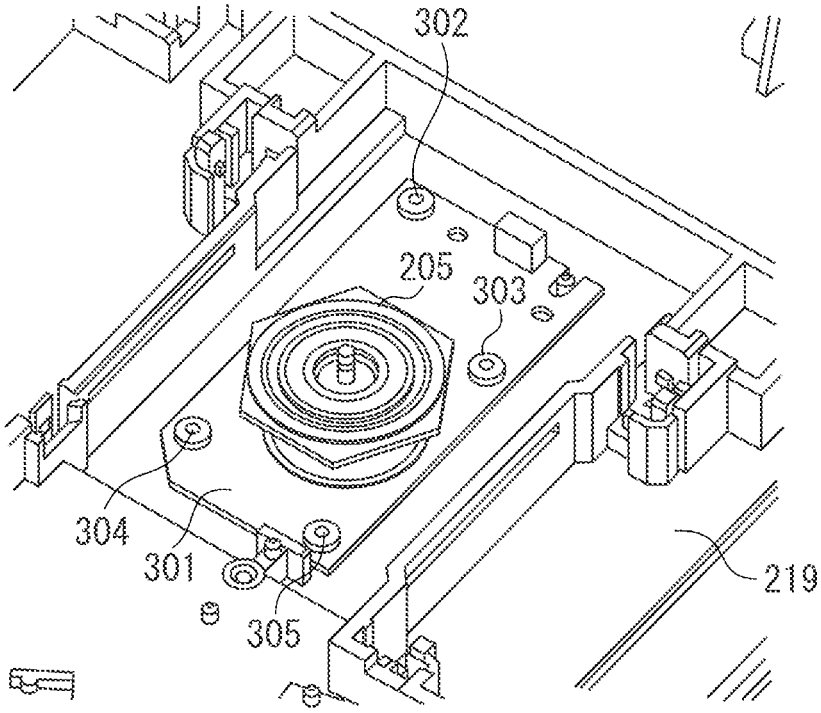
Figure 3C:
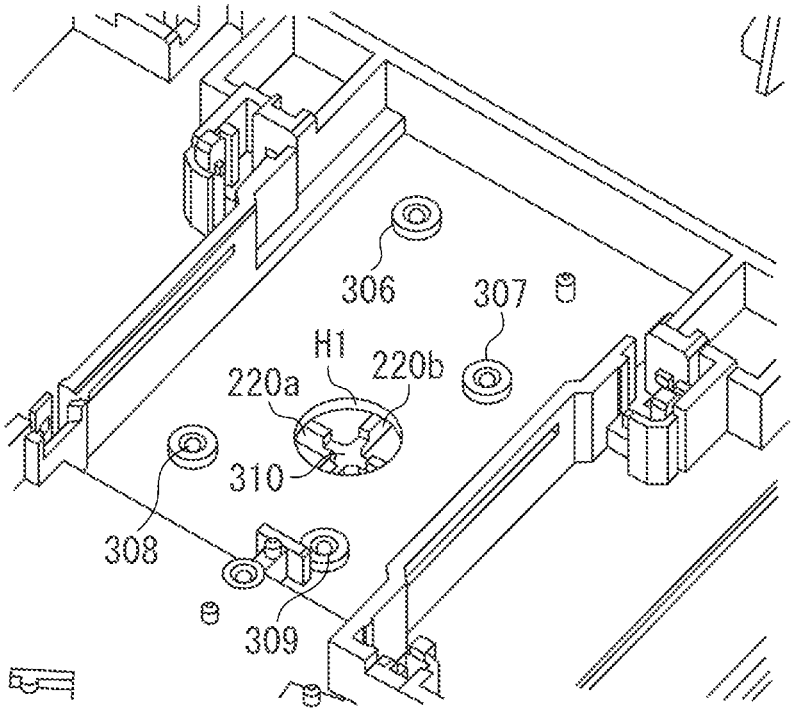
Figure 4:
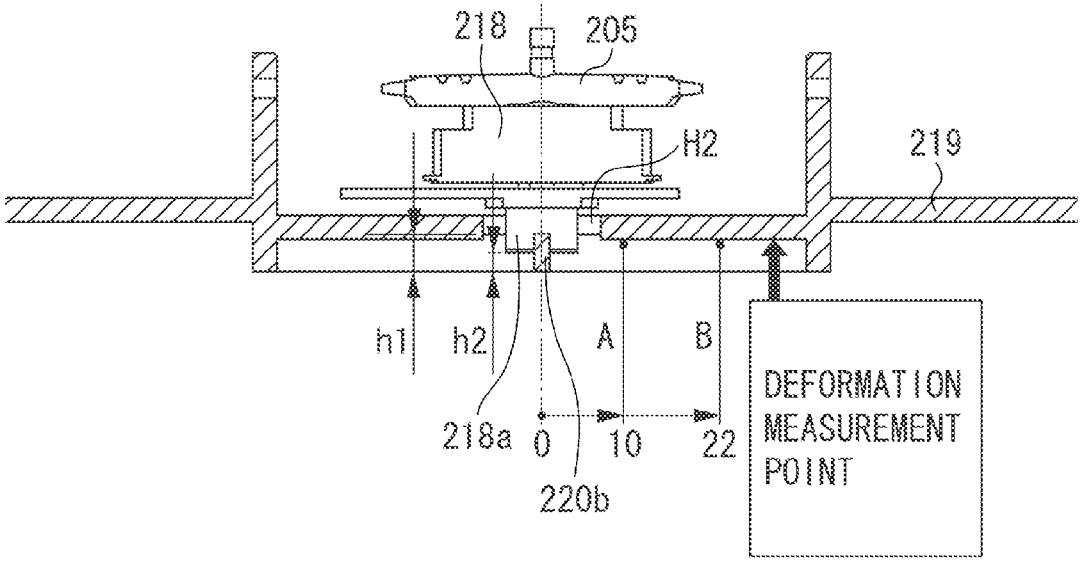
FIG. 4 is a cross-sectional view illustrating a peripheral portion of a polygon mirror.

The opening will be described below. FIG. 3A is a perspective view illustrating the housing 219 of the optical scanning apparatus described with reference to FIGS. 2A and 2B. FIG. 3B is an enlarged view illustrating the periphery of the polygon mirror 205 illustrated in FIG. 3A. FIG. 3C is an enlarged view illustrating the periphery of the position where the polygon mirror 205 was disposed in a state that the polygon mirror 205 has been removed. FIGS. 3A, 3B, and 3C illustrate only the polygon mirror 205 disposed in the housing 219. However, the lenses and the reflection mirrors above described are actually disposed in the housing 219. Further, FIG. 4 is a cross-sectional view of the peripheral portion of the polygon mirror 205.

Referring to FIG. 3B, the polygon mirror 205 and the drive motor 218 are mounted on a substrate 301 on which an integrated circuit (IC) for driving the drive motor 218 is mounted. The drive motor 218 is disposed under the polygon mirror 205 in FIG. 3B. At the time of assembling the optical scanning apparatus, the substrate 301 is mounted on bearing surfaces 306, 307, 308, and 309 disposed on the housing 219 as illustrated in FIG. 3C, and fixed on the bearing surfaces by screws 302, 303, 304, and 305 illustrated in FIG. 3B.

Referring to FIG. 3C, an opening H1 is formed on the bottom of the housing 219. The substrate 301 is screw-fixed to the bearing surfaces 306, 307, 308, and 309 on the housing 219, and a bearing 218*a* of the drive motor 218 (refer to FIG. 4) is inserted into the opening H1. The bearing 218*a* of the drive motor 218 is not engaged with the opening H1 along an entire periphery in a rotational direction of the shaft in the bearing 218*a*. There is a section along the entire circumference direction of the bearing 218*a* in which a portion of the bearing 218*a* is not in contact with the housing 219. Specifically, the opening H1 in the housing 219 is shaped with respect to the shape of the bearing 218*a* so that, when the bearing 218*a* of the drive motor 218 is seated (inserted) into the opening H1 in the housing 219, a gap H2 is formed. The gap H2 which is capable of ventilation is formed in at least a portion between the housing 219 and the bearing 218*a*.

As a result, air inside the housing 219 is released to outside the housing 219, and the air outside the housing 219 enters the housing 219 through the gap H2 formed between the housing 219 and the bearing 218*a*. The heat inside the housing 219 is thus released by the air inside the housing 219 being released to the outside. Further, the housing 219 and the optical members disposed inside the housing 219 are cooled by the air outside the housing 219 (i.e., the air which is relatively cooler as compared to inside the housing 219) entering the housing 219. Furthermore, an air layer is formed between the bearing 218*a* and an edge of the opening H1 by having the gap H2, so that it becomes difficult for the heat to be transferred from the bearing 218*a* to the edge of the opening H1 (i.e., the bottom of the housing 219). It thus prevents the housing 219 to be locally deformed due to heat, and distortion of the housing 219 can be reduced.

According to the present exemplary embodiment, the opening H1 is formed in the vicinity of the drive motor 218. However, the location of the opening H1 is not limited to the above. A similar result as described above can be expected by forming the opening H1 in a location corresponding to the area in which the temperature becomes relatively high in the housing 219.

According to the present exemplary embodiment, the bearing 218*a* of the drive motor 218 is inserted into the opening H1, so that the temperature around the opening greatly rises as compared to other areas in the housing 219. Since the edge portion of the opening H1 is a free end, it can be easily deformed by heat. Basin-like shape deformation may thus be generated in the housing 219 as illustrated in FIG. 14 when the image forming apparatus performs an image formation process.

To solve such a problem, according to the present exemplary embodiment, the rib, i.e., the reinforcement unit, is disposed in the optical scanning apparatus to secure the rigidity (i.e., strength) of the peripheral portion of the opening H1. As illustrated in FIG. 3C, ribs 220*a* and 220*b* connect the edges of the opening H1 in such a way the ribs 220*a* and 220*b* cross over the opening H1.

Figure 5A:
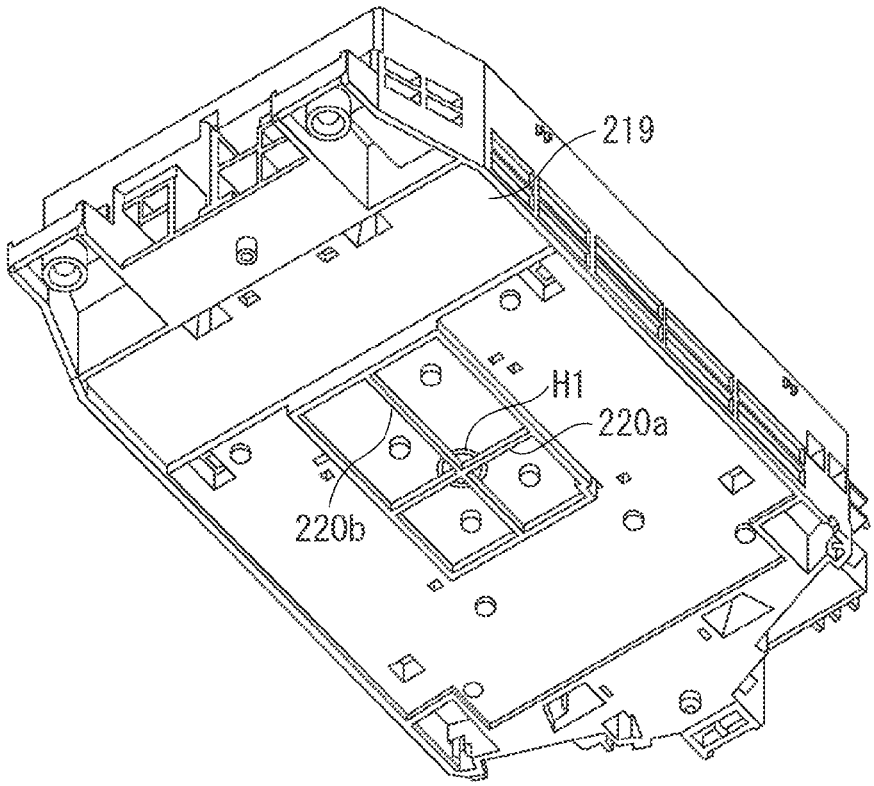
FIGS. 5A and 5B are perspective view and an enlarged view thereof illustrating an exterior of the optical scanning apparatus.

The reinforcement units will be described in detail below with reference to FIGS. 5A and 5B. FIG. 5A is a perspective view illustrating an exterior portion of the housing 219 of the optical scanning apparatus. The ribs 220*a* and 220*b*, i.e., the reinforcement units, are stood (vertically-stood) from the external of the housing 219 (i.e., the back surface of the surface on which the drive motor is disposed inside the housing 219).

Figure 5B:
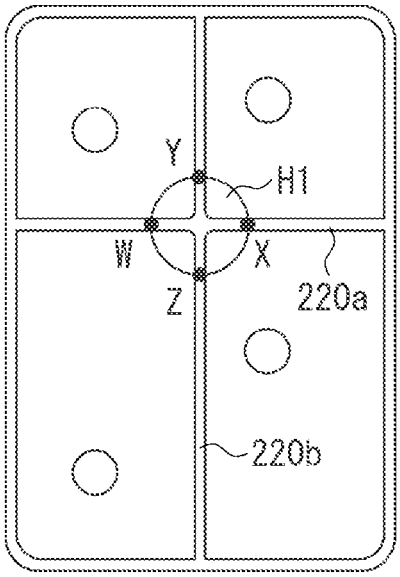
Figure 6:
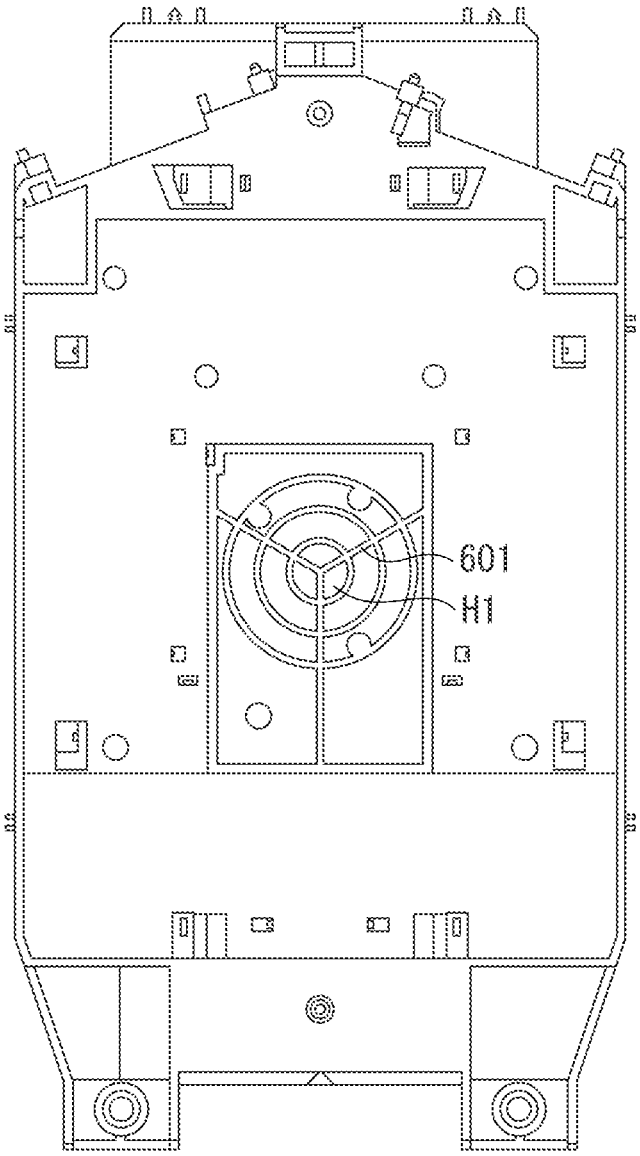
FIG. 6 is another example of an optical scanning apparatus according to a first exemplary embodiment.

FIG. 5B illustrates only the ribs 220*a* and 220*b* as extracted from the exterior portion of the optical scanning apparatus illustrated in FIG. 5A. Referring to FIG. 5B, when the opening H1 is viewed from a direction of the rotational shaft of the drive motor 218, each of the ribs 220*a* and 220*b* crosses (or longitudinally traverses) the opening H1. Further, the ribs 220*a* and 220*b* intersect on an extended direction from the rotational shaft of the drive motor 218. According to the present exemplary embodiment, a plurality of ribs 220*a* and 220*b* is disposed. However, there may be only one rib 220*a*, or three or more ribs. For example, as illustrated in FIG. 6, the ribs may be shaped to radiate in a Y-shape from the center of the opening of the drive motor 218 along the bottom surface of the housing 219. Referring to FIG. 6, a rib 601 is radially-extended from the center of the opening H1 along the bottom surface of the housing 219.

Referring to FIG. 5B, the rib 220*a* is a reinforcement unit which connects a point W and a point X on the edge portion of the opening H1 to maintain a relative positional relation between the points W and X. Further, the rib 220*b* is a reinforcement unit which connects a point Y and a point Z on the edge portion of the opening H1. The points W, X, Y, and Z correspond to the rim (edge) of the opening H1.

An engagement portion to which the bearing 218*a* is to be engaged will be described below with reference to FIGS. 3C, 4, and 7. Referring to FIG. 3C, a notch portion (i.e., a step portion) which is an engagement unit 310 to which the bearing 218*a* becomes engaged is formed on the ribs 220*a* and 220*b* (hereinafter referred to as a cross rib 220).

Figure 7:
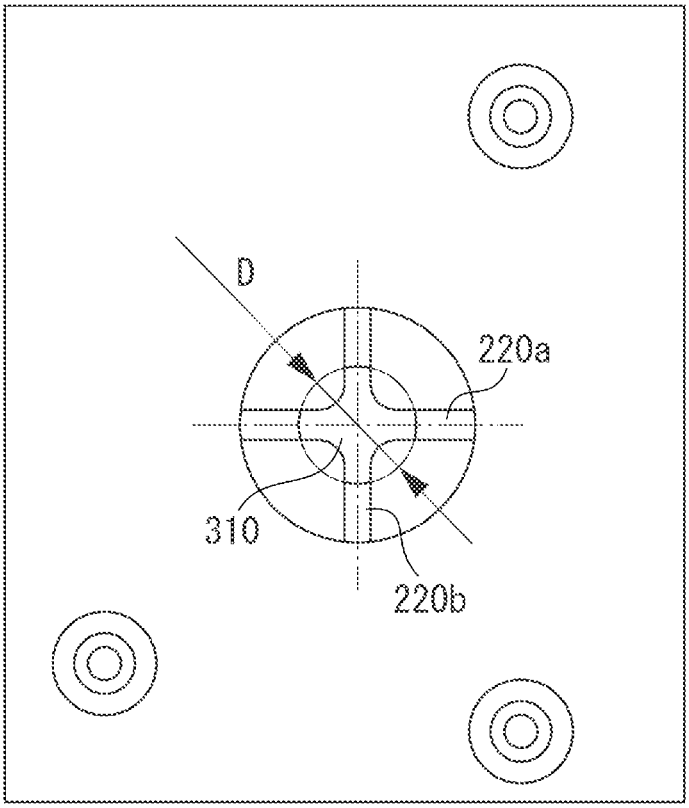
FIG. 7 is a top view illustrating a periphery of an opening.

FIG. 7 illustrates the opening H1 and the cross rib 220 as viewed from the direction of the rotational shaft of the drive motor 218. Referring to FIG. 7, a step of width D is formed on each of the ribs 220*a* and 220*b*. The bearing 218*a* of the drive motor 218, which is cylindrically-shaped and having a diameter D, is formed of material such as brass. The bearing 218*a* of the drive motor 218 is thus engaged with the engagement unit. At the time of assembling the optical scanning apparatus, the bearing 218*a* is engaged with the engagement unit 310 to position the drive motor 218, and the substrate 301 is then fixed by the screws 302, 303, 304, and 305.

Dimensions of the ribs will be described below with reference to FIG. 4. For ease of description, FIG. 4 illustrates only the rib 220*b* among the cross rib 220, and the rib 220*a* is omitted. The cross rib 220 drops in height by one step from a height h1 to a height h2 at midway extending from the edge of the opening H1 on the housing 219 toward the center of the opening H1. The bearing 218*a* thus becomes engaged with the difference in height. According to the present exemplary embodiment, h1 is approximately 5 mm, h2 is approximately 2.5 mm, and a width W of the rib is approximately 2 mm.

Figure 8A:
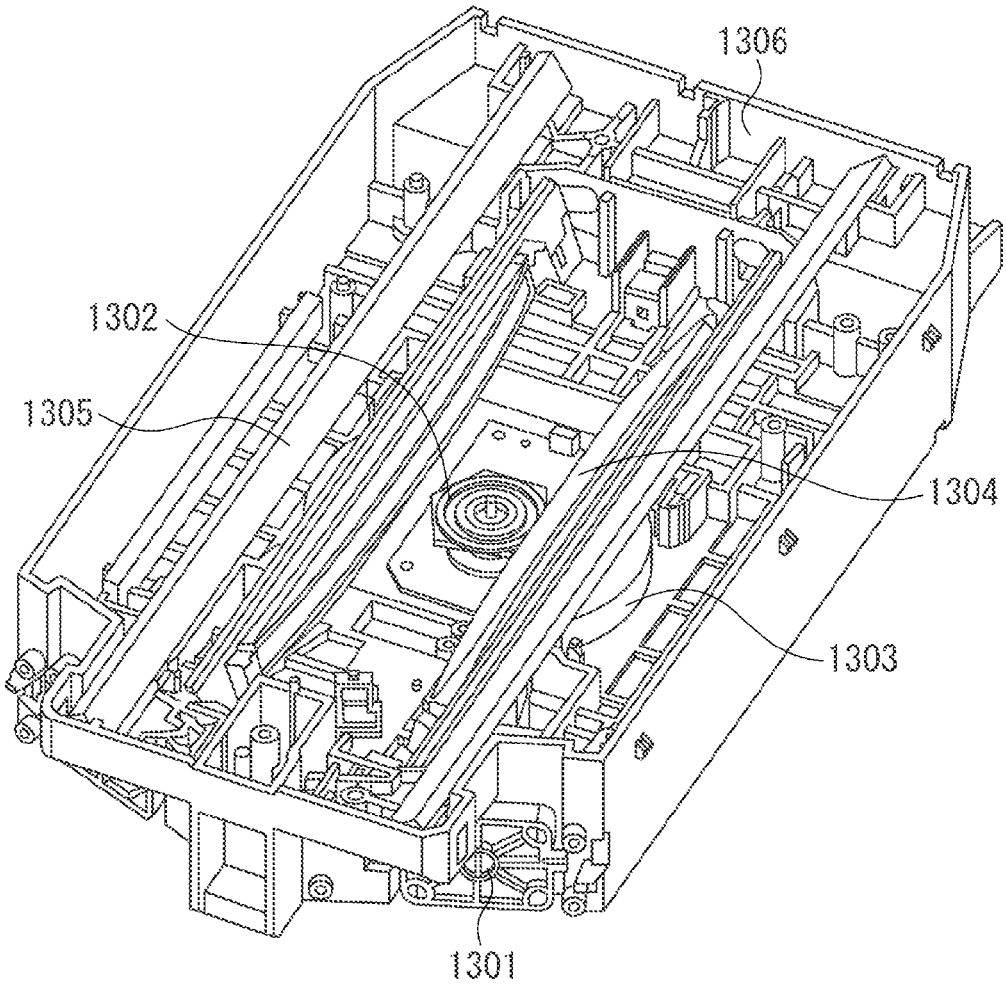
FIGS. 8A and 8B illustrate comparison examples of the optical scanning apparatus with respect to the present exemplary embodiment.
Figure 8B:
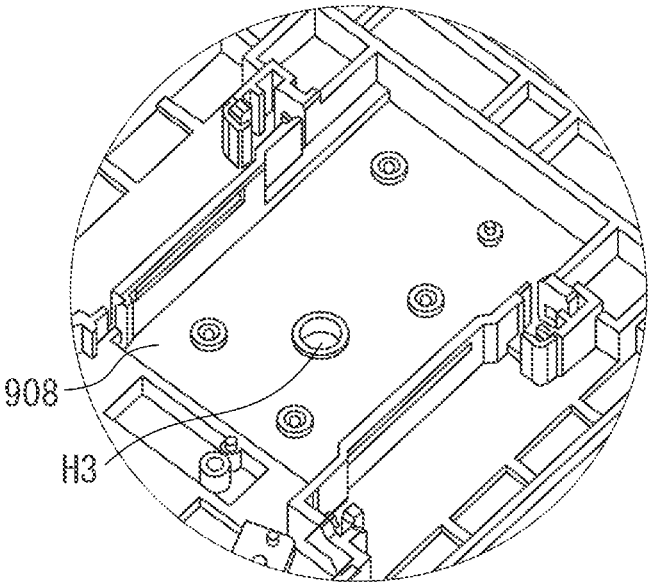
Figure 13:
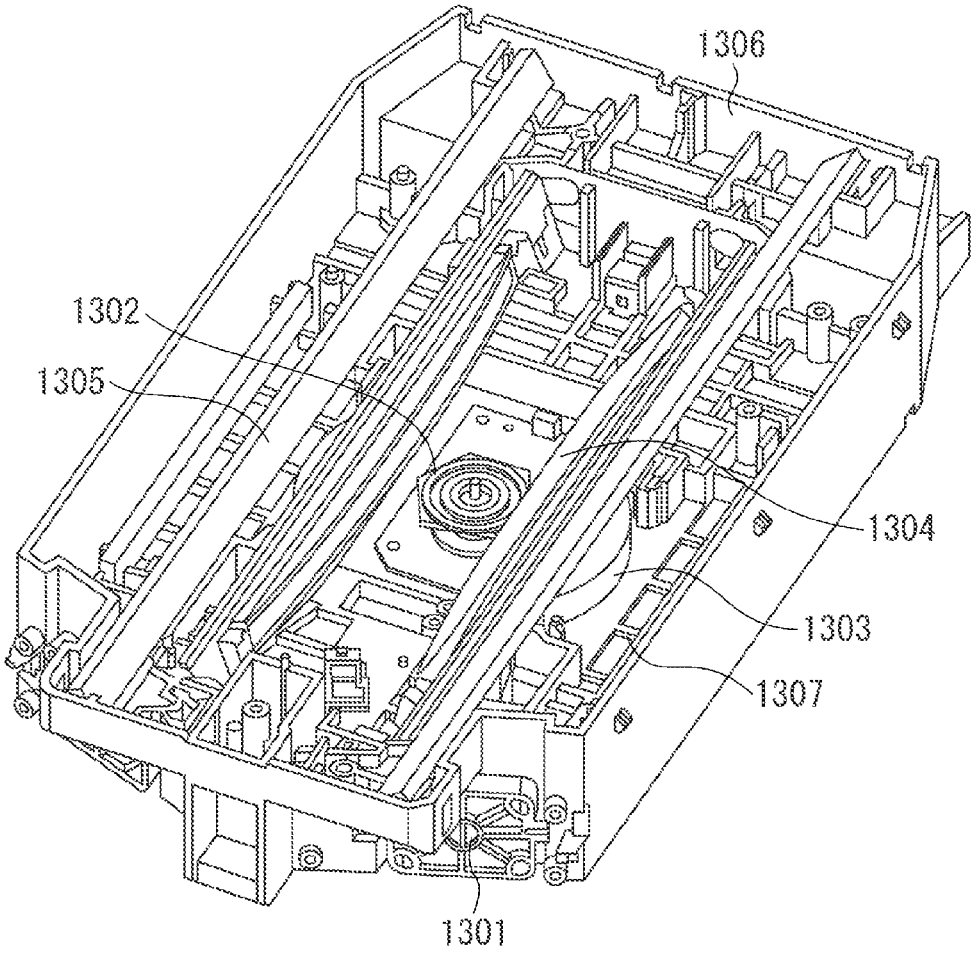
FIG. 13 is a perspective view illustrating a conventional example of the optical scanning apparatus.

The effect acquired according to the present exemplary embodiment will be described below. FIGS. 8A and 8B illustrate the optical scanning apparatus which is a comparison example with respect to the present exemplary embodiment, and is the same as the optical scanning apparatus illustrated in FIG. 13. FIG. 8B is an enlarged view illustrating an installation location of the polygon mirror. In the comparison example, an opening H3, wherein the diameter of the opening H1 is greater than the diameter of the opening H3 (H1>H3), is formed on the bottom of the housing 1306. The bearing of drive motor contacts with the housing 1306 along an entire periphery, so that the gap H2 is not formed due to the housing 1306 and the bearing of the drive motor, unlike the present exemplary embodiment. As a result, ventilation between inside the housing 1306 and outside the housing 1306 is impossible.

Figure 9:
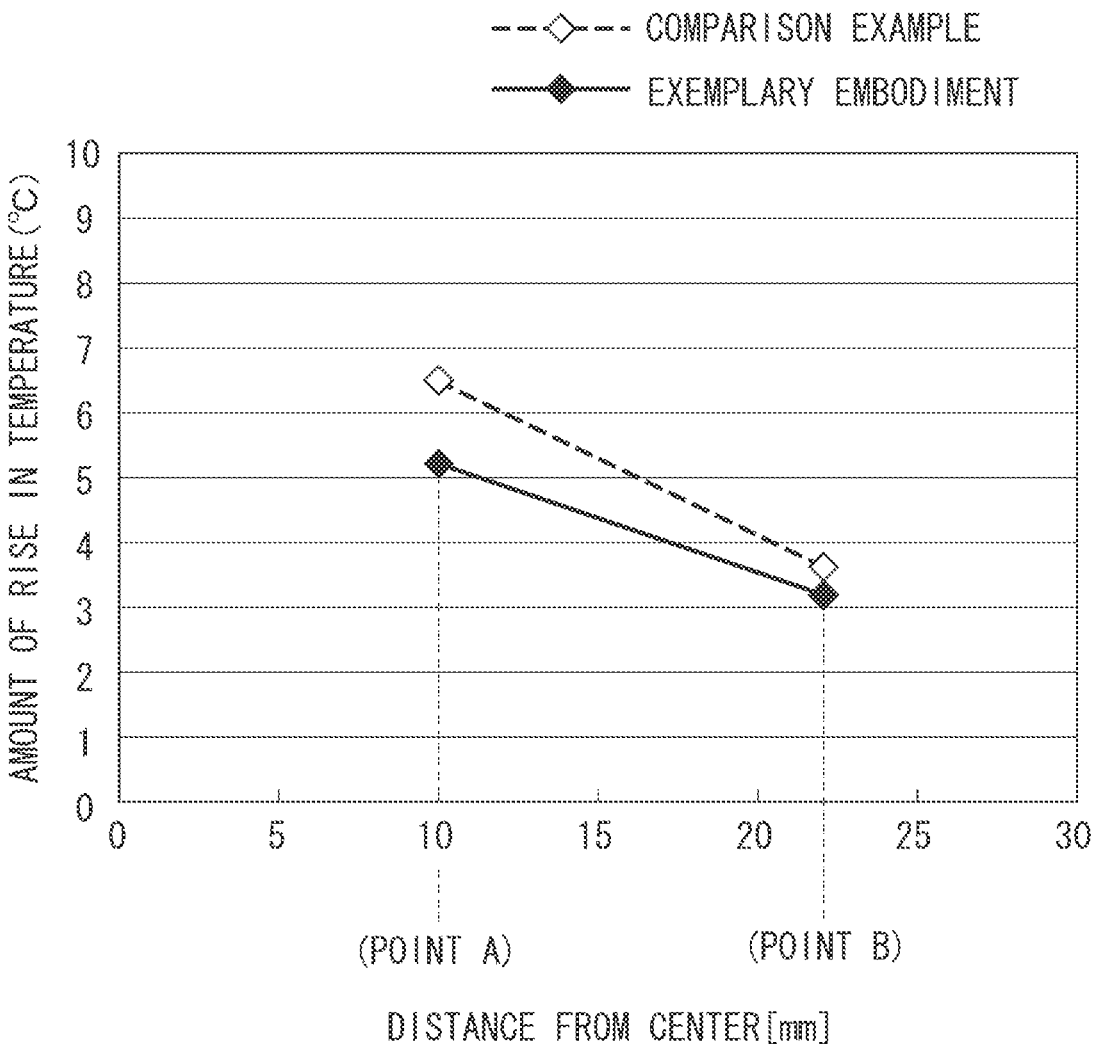
FIG. 9 illustrates an effect acquired by the optical scanning apparatus according to the first exemplary embodiment.

FIG. 9 illustrates a difference of the temperature distribution in the housing 219 between the present exemplary embodiment and the comparison example. More specifically, FIG. 9 illustrates the rise in the temperature during 10 minutes from when the drive motor has started to be driven, at each of points A and B illustrated in the cross-sectional view of FIG. 4. A distance from the center of the drive motor to point A is approximately 10 mm, and a distance from the center of the drive motor to point B is approximately 22 mm.

Referring to FIG. 9, an experiment result acquired according to the present exemplary embodiment is indicated by a solid line, and an experiment result acquired according to the comparison example is indicated by a broken line. A temperature gradient between point A and point B is approximately 1° C. lower in the result acquired according to the present exemplary embodiment as compared to the result acquired according to the comparison example. It can thus be determined that it is harder to generate an uneven linear expansion which distorts the housing according to the present exemplary embodiment as compared to the comparison example.

Figure 10:
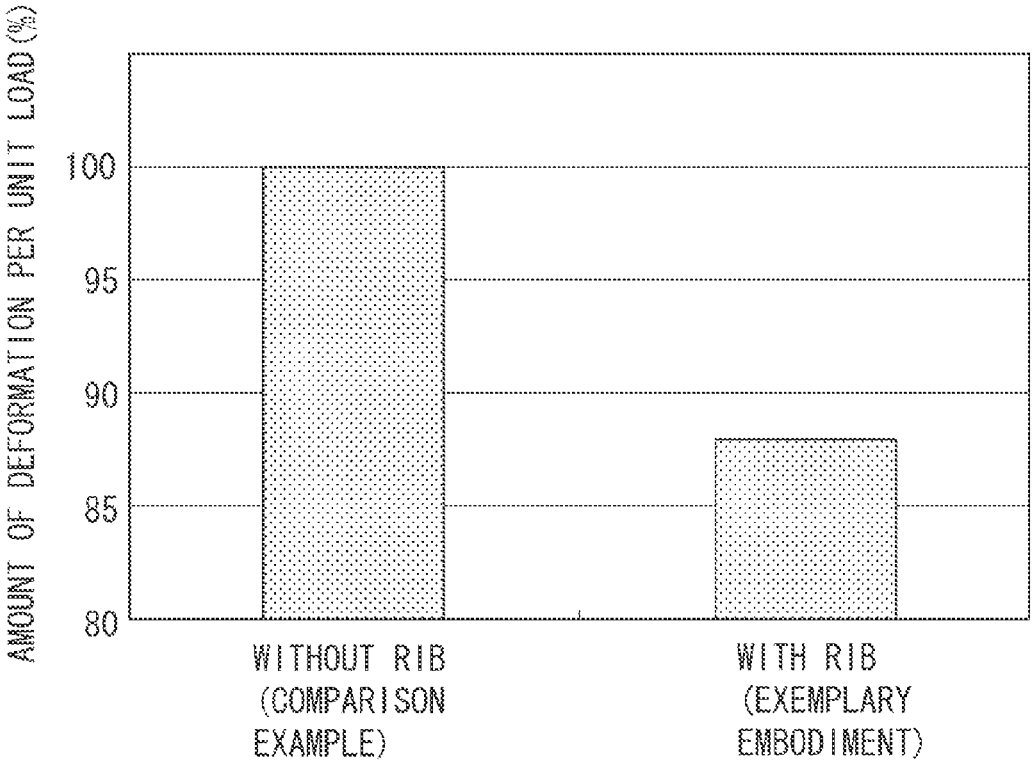
FIG. 10 illustrates an effect acquired by the optical scanning apparatus according to the first exemplary embodiment.

FIG. 10 illustrates results of analyzing static strength of the peripheral portions of the openings H1 and H3 according to the present exemplary embodiment and the comparison example. More specifically, FIG. 10 illustrates the amounts of deformation in the edges of the openings H1 and H3 when a unit load in the direction of the rotational shaft of the drive motor is applied to the peripheries of the openings H1 and H3. Referring to FIG. 10, if the amount of deformation is set as 100% for the comparison example in which there is no cross rib 220, the amount of deformation according to the present exemplary embodiment remains at approximately 88%. It can be understood that the strength is improved by 12% according to the present exemplary embodiment as compared to the comparison example. Further, if a cross-sectional area of the rib is increased, the strength of the periphery portion of the opening H1 can be increased.

Figure 11:
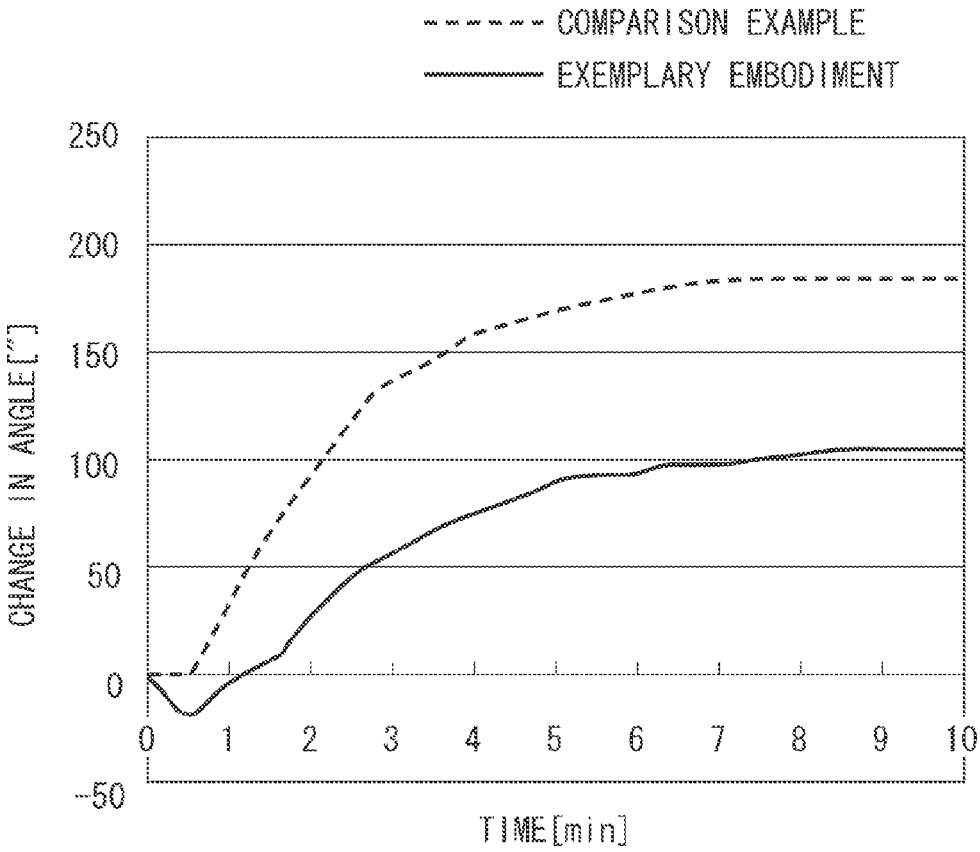
FIG. 11 illustrates an effect acquired by the optical scanning apparatus according to the first exemplary embodiment.

FIG. 11 illustrates results of measuring the amounts of deformation (i.e., an inclination) of a portion indicated by a bold arrow (i.e., a deformation measurement point) illustrated in the cross-sectional view of FIG. 4. More specifically, FIG. 11 illustrates how an angle of a plane at the measurement point has changed in 10 minutes from when the motor has started to be driven. The amount of change according to the conventional example is approximately 180 seconds. In contrast, according to the present exemplary embodiment, the amount of change is reduced to 100 seconds, so that the deformation can be reduced by 45% according to the present exemplary embodiment as compared to the comparison example.

As described above, the opening H1 is formed to be capable of ventilation between inside and outside the housing 219. The rigidity of the housing 219 in the peripheral portion of the opening H1 which has been lowered by formation of the opening H1 is secured by disposing the ribs which cross over or traverse the opening H1. Generation of heat deformation of the housing 219 when the drive motor 218 is driven can thus be reduced.

The second exemplary embodiment will be described below. According to the first exemplary embodiment, the opening H1, which is capable of ventilation, is formed between the housing 219 and the bearing 218*a* in the optical scanning apparatus. However, according to the first exemplary embodiment, dust may enter the housing 219 via the opening H1. According to the present exemplary embodiment, the opening H1 is closed by a dust preventing seal to improve dust prevention as compared to the first exemplary embodiment.

Figure 12A:
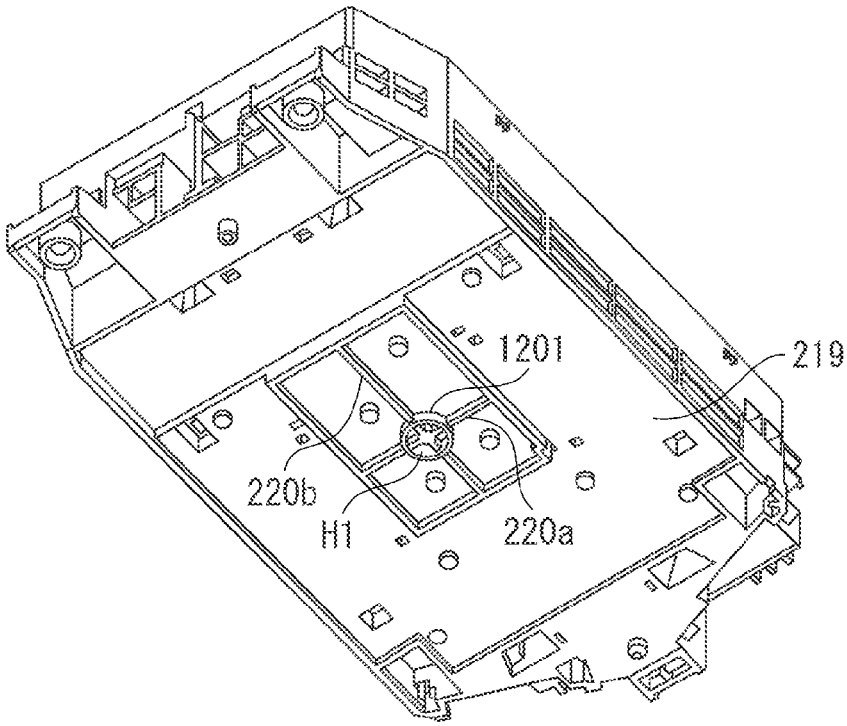
FIGS. 12A and 12B are schematic perspective views illustrating exterior of an optical scanning apparatus according to a second exemplary embodiment.
Figure 12B:
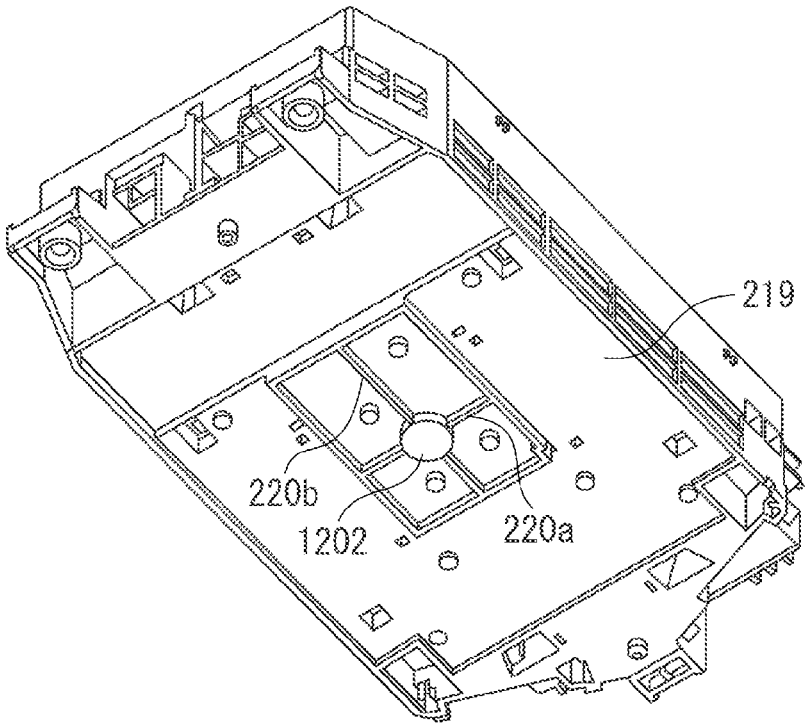

FIGS. 12A and 12B are perspective views illustrating the exterior portion of the housing used in the optical scanning apparatus according to the present exemplary embodiment. The opening H1, and the ribs 220*a* and 220*b*, which are disposed to cross over the opening H1, are similar to the first exemplary embodiment. However, a rib 1201 disposed as a reinforcement unit surrounding the opening is different from the first exemplary embodiment. The height of the rib 1201 from the bottom surface of the housing is higher than the heights of the ribs 220*a* and 220*b* from the bottom surface of the housing. Further, according to the present exemplary embodiment, the rib 1201 surrounding the opening and rib 220*a*, and the rib 1201 and the rib 220*b* are connected respectively in the optical scanning apparatus. The strength of the peripheral portion of the opening is thus higher as compared to the first exemplary embodiment owing to the rib 1201.

FIG. 12B illustrates the optical scanning apparatus in which a dust preventing seal 1202, i.e., a dust prevention member, is attached. The opening H1 formed by the housing 219 and the bearing 218*a* is covered by attaching the dust preventing seal 1202, so that the dust entering the housing 219 can be reduced. Further, the dust preventing seal 1202 is formed of a material whose heat-transfer coefficient is higher than the resin used in forming the housing 219. As a result, the heat inside the housing is more easily released to the outside as compared to a configuration in which the opening H1 is covered with resin. According to the present exemplary embodiment, a thickness of the dust preventing seal 1202 may be thinner than the thickness of the bottom of the housing 219. The heat inside the housing 219 can thus be more easily released to outside the housing 219 via the dust preventing seal 1202 as compared to the configuration in which there is no opening formed on the bottom surface of the housing 219.

As described above, the rigidity of the peripheral portion of the opening H1 can be increased by disposing the rib 1201, which connects to the ribs 220*a* and 220*b* and surrounds the opening H1. Further, the dust can be prevented from entering the housing by attaching the dust preventing seal 1202 on the rib 1201 whose height from the bottom surface of the housing is higher than that of the ribs 220*a* and 220*b*.

Figure 15A:
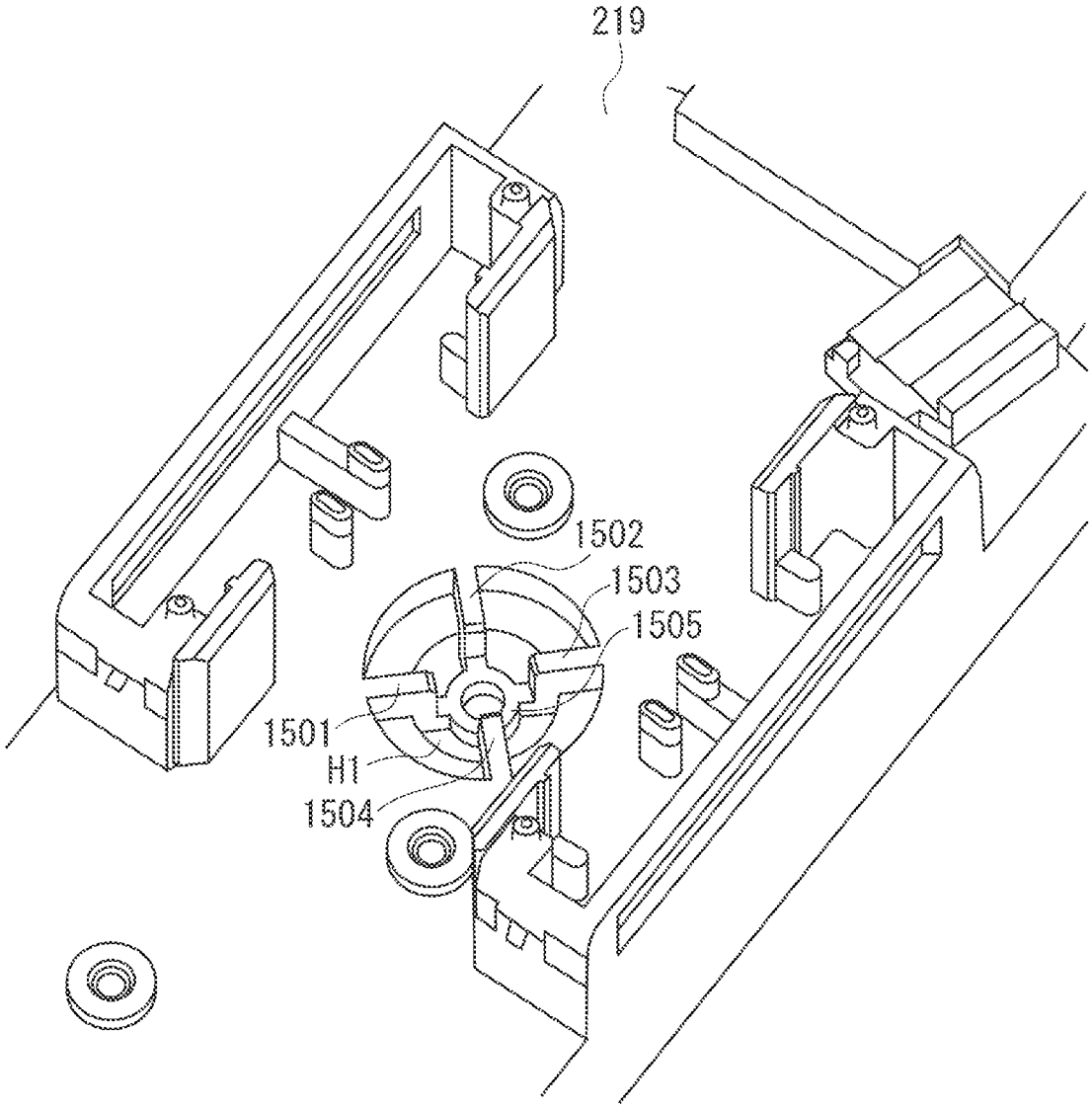
FIG. 15 illustrates another example of the optical case.
Figure 15B:
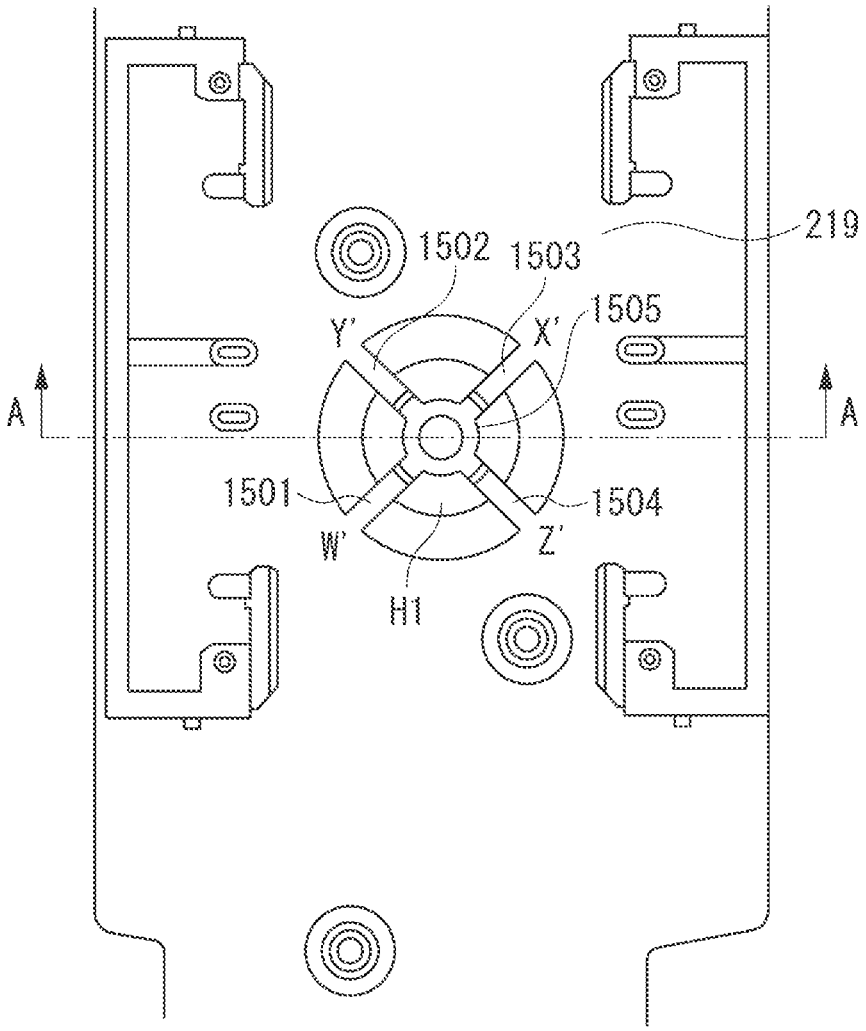
Figure 15C:
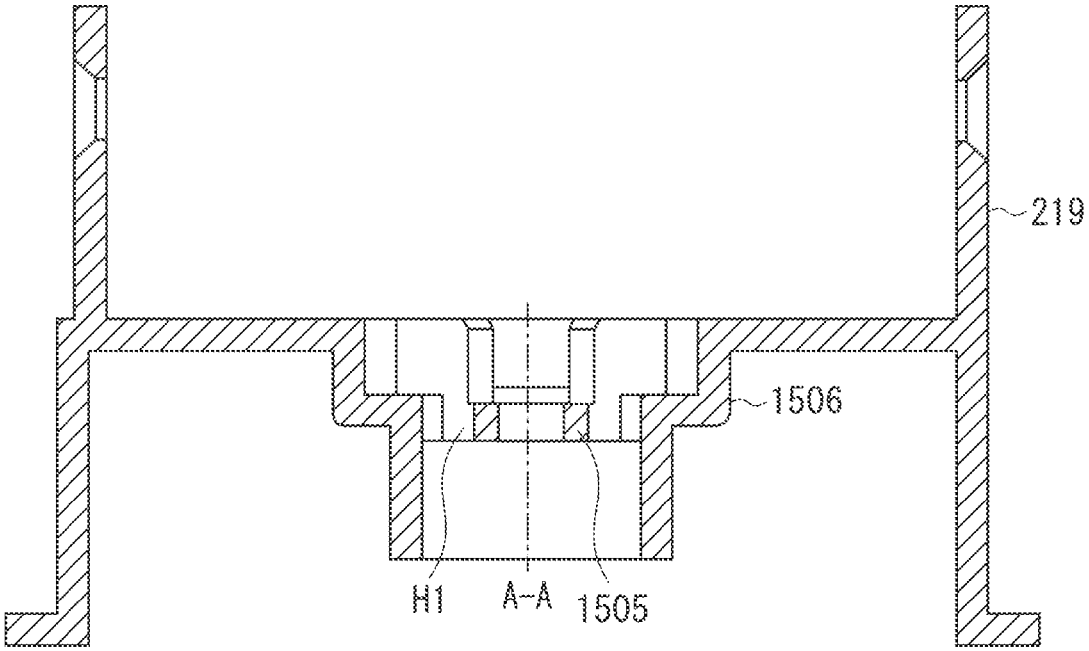

The shape of the ribs are not limited to the shapes illustrated in FIG. 3C according to the first exemplary embodiment and FIG. 12A according to the present exemplary embodiment. Another shape of the rib will be described below with reference to FIGS. 15A and 15B. FIG. 15A is a perspective view illustrating the area surrounding the opening H1 in the housing 219. FIG. 15B is a top view of FIG. 15A. FIG. 15C is a cross-sectional view taken along a line A-A illustrated in FIG. 15B. Referring to 15A, ribs 1501, 1502, 1503, and 1504 extend from each of edges W', X', Y', and Z' of the opening H1 to the center portion of the opening H1. Each of the ribs 1501, 1502, 1503, and 1504 is connected to a circular rib 1505 formed at the center portion of the opening H1. The shape of the rib is thus not limited to the cross-shaped rib as illustrated in FIG. 3C.

Further, referring to FIG. 15C, a reinforcement unit 1506 is disposed on the exterior portion of the housing 219 to surround the opening H1, to increase the rigidity of the opening H1. The reinforcement unit 1506 and each of the ribs 1501, 1502, 1503, and 1504 may be connected as illustrated in FIG. 12A to increase the rigidity.

OTHER EMBODIMENTS

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-094156 filed Apr. 20, 2011 and Japanese Patent Application No. 2012-029865 filed Feb. 14, 2012, each of which is hereby incorporated by reference herein in their entirety.

What is claimed is:

1. An optical scanning apparatus comprising:

a light source to emit a light beam;

a rotational polygon mirror configured to deflect the light beam so the deflected light beam scans a photosensitive member;

a motor configured to drive the rotational polygonal mirror;

a bearing configured to bear a rotational shaft of the motor;

an optical box on which an opening is formed and in which the rotational polygon mirror, the motor and the bearing are disposed, the bearing being inserted into the opening, and a gap being formed between the bearing and the optical box into which the bearing is inserted; and a connecting portion integral with the optical box and extending across the opening, wherein a portion of the connecting portion that extends across the opening is opposed to an end face of the bearing.

2. The optical scanning apparatus according to claim 1, wherein the optical box includes an engagement portion to be engaged with the bearing, and wherein the engagement portion is disposed integrally with the connecting portion and the optical box.

3. An image forming apparatus comprising:

a photosensitive member;

the optical scanning apparatus according to claim 2, the optical scanning apparatus configured to form an electrostatic latent image on the photosensitive member by scanning the photosensitive member with the light beam reflected by the rotational polygon mirror; and a developing unit configured to develop as a toner image the electrostatic latent image formed on the photosensitive member.

4. The optical scanning apparatus according to claim 1, wherein the connecting portion intersects on an extended line of the rotational shaft of the motor.

5. The optical scanning apparatus according to claim 1, further comprising a fixing unit configured to fix the rotational polygon mirror to a predetermined surface inside the optical box wherein the connecting portion extends from an external surface of the optical box, which is a back side of the predetermined surface.

6. The optical scanning apparatus according to claim 5, further comprising a reinforcement portion extending from the external surface of the optical box and configured to surround the opening, wherein the connecting portion and the reinforcement portion are integrally connected.

7. The optical scanning apparatus according to claim 6, wherein a height of the reinforcement portion from the external surface is higher than a height of the connecting portion from the external surface, and wherein a dust preventing seal is attached to the reinforcement portion and configured to prevent dust from entering the optical box from the opening.

8. The optical scanning apparatus according to claim 1, wherein the connecting portion is formed on an inner periphery of the reinforcement portion.

9. The optical scanning apparatus according to claim 6, further comprising a seal attached to the reinforcement portion.

10. The optical scanning apparatus according to claim 1, wherein an aperture is formed on the connecting portion.

11. The optical scanning apparatus according to claim 1, wherein the bearing is positioned in the opening.

12. The optical scanning apparatus according to claim 1, wherein the rotational polygon mirror is configured to reflect a first light beam emitted from a first light source in a first direction and reflect a second light beam emitted from a second light source in a second direction different from the first direction.

13. The optical scanning apparatus according to claim 1, wherein the connecting portion is fixed to an external surface of the optical box in such a way that the connecting portion connects edges of the opening.

14. The optical scanning apparatus according to claim 1, wherein the portion of the connecting portion extending across the opening engages with the end face of the bearing.

15. The optical scanning apparatus according to claim 1, further comprising at least two connecting portions extending across the opening, wherein a portion of each connecting portion that extends across the opening is opposed to the end face of the bearing.

16. The optical scanning apparatus according to claim 15, wherein the at least two connecting portions intersect with each other.

17. An optical scanning apparatus comprising:

a light source to emit a light beam;

a rotational polygon mirror configured to deflect the light beam so the deflected light beam scans a photosensitive member;

a motor configured to drive the rotational polygonal mirror;

a bearing configured to bear a rotational shaft of the motor;

an optical box on which an opening is formed and in which the rotational polygon mirror, the motor and the bearing are disposed, the bearing being inserted into the opening, and a gap being formed between the bearing and the optical box into which the bearing is inserted; and a connecting portion disposed integrally with the optical box and arranged across the opening, the connecting portion arranged opposed to an end face of the bearing.

* * * * *